US008382263B2

(12) United States Patent
Okajima

(10) Patent No.: US 8,382,263 B2
(45) Date of Patent: Feb. 26, 2013

(54) INK FILLING METHOD

(75) Inventor: Masakazu Okajima, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 0 days.

(21) Appl. No.: 13/257,598

(22) PCT Filed: Mar. 23, 2009

(86) PCT No.: PCT/JP2009/055660

§ 371 (c)(1),
(2), (4) Date: Sep. 19, 2011

(87) PCT Pub. No.: WO2010/109578

PCT Pub. Date: Sep. 30, 2010

(65) Prior Publication Data

US 2012/0062660 A1 Mar. 15, 2012

(51) Int. Cl.
*B41J 2/175* (2006.01)
*B41J 2/165* (2006.01)

(52) U.S. Cl. ..... 347/85; 347/29; 347/30

(58) Field of Classification Search ..... 347/29, 347/30, 85

See application file for complete search history.

(56) References Cited

U.S. PATENT DOCUMENTS

| | | | | |
|---|---|---|---|---|
| 7,325,908 | B2 * | 2/2008 | Katoh et al. | 347/85 |
| 7,845,759 | B2 * | 12/2010 | Umeda | 347/92 |
| 2006/0103700 | A1 * | 5/2006 | Taira | 347/85 |

FOREIGN PATENT DOCUMENTS

| | | |
|---|---|---|
| JP | 2002-103645 | 4/2002 |
| JP | 2004-114411 | 4/2004 |
| JP | 2004-230906 | 8/2004 |
| JP | 2005-161130 | 6/2005 |
| JP | 2009-045848 | 3/2009 |

* cited by examiner

*Primary Examiner* — Jannelle M Lebron
(74) *Attorney, Agent, or Firm* — Jianq Chyun IP Office

(57) ABSTRACT

In an ink filling method according to the present invention, a suction arrangement having a pump is air-tightly coupled to a head unit having a plurality of ink supply ports, and sucking is performed by using the pump, thereby supplying an ink stored in an ink supply source to a plurality of the ink supply ports via a flow channel arrangement including one ink flow channel that communicates with the ink supply source and a plurality of branched flow channels that branch out from the ink flow channel and communicate with corresponding ones of the ink supply ports. The sucking is stopped from a time point when one of the branched flow channels is entirely filled with the ink until air in the flow channel arrangement moves in a branching portion, and the sucking is resumed when the air has moved in the branching portion.

8 Claims, 3 Drawing Sheets

INK FILLING METHOD

CROSS-REFERENCE TO RELATED APPLICATION

This application is a 371 of international application of PCT application serial no. PCT/JP2009/055660, filed on Mar. 23, 2009. The entirety of the above-mentioned patent application is hereby incorporated by reference herein and made a part of this specification.

TECHNICAL FIELD

The present invention relates to an ink filling method for charging an ink into a printer head having a plurality of ink supply ports in an inkjet printer. More particularly, the present invention relates to an ink filling method that allows charging the ink without leaving behind air in a flow channel arrangement.

BACKGROUND ART

The following structure is typically adapted in a printer head of an inkjet printer. An ink is supplied from an ink supply source (ink tank) to an ink supply port of a head unit via an ink flow channel, and a predetermined pressure is selectively applied, using a plate-shaped piezoelectric actuator arranged on the head unit, to a pressure chamber that communicates with a plurality of nozzle pores and the ink is discharged from each nozzle pore.

A flow channel arrangement (ink tube) made of resin and constituting the ink flow channel couples the ink supply port of the head unit and the ink flow channel. The flow channel arrangement is coupled to the ink tank. Consequently, the ink is supplied from the ink tank to the head unit via the flow channel arrangement.

Meanwhile, a technique is known in which a plurality of the ink supply ports is arranged in the head unit and the ink is supplied to the ink supply ports via branched flow channels that branch from one ink flow channel (see, for example, Patent Document 1).

Such a structure is employed to supply the ink to a plurality of locations on a nozzle plate in a divided manner to thereby uniformly discharge the ink from an entire surface of the nozzle plate that is arranged below the head unit. That is, a device that employs this technique includes one ink flow channel that communicates with the ink supply source, and the flow channel arrangement constituting a plurality of the branched flow channels that branch out from the ink flow channel and communicate with the corresponding ones of the ink supply ports of the head unit.

When the inkjet printer is operated for the first time, or when the printer head is replaced, charging of the ink into the printer head (so called initial charging) is performed, for example, in the following manner. That is, the surface of the nozzle plate is air-tightly covered with a cap, and air inside the cap is sucked by using a pump (see, for example, Patent Document 1).

The conventional charging method involving simply continuing sucking of the ink has a problem that, as shown in FIG. 5, air may be left inside the flow channel arrangement. This air hampers the supply of the ink during printing and causes a discharge failure.

CONVENTIONAL ART DOCUMENTS

Patent Document 1: Japanese Patent Application Laid-open No. 2004-230906.

DISCLOSURE OF INVENTION

Problem to be Solved by the Invention

The present invention has been made in view of the above discussion. It is an object of the present invention to provide an ink filling method that allows, when charging an ink into a printer head that has a plurality of ink supply ports, charging the ink without leaving behind air in a flow channel arrangement that causes a discharge failure.

Means for Solving Problem

An ink filling method for a printer head according to Claim 1 of the present invention includes a head unit that has a plurality of ink supply ports and that performs printing by discharging an ink from a nozzle plate provided in a lower portion; an ink supply source arranged outside the head unit; and a flow channel arrangement including one ink flow channel that communicates with the ink supply source, and a plurality of branched flow channels that branch out from the ink flow channel and communicate with corresponding ones of the ink supply ports, the ink filling method includes air-tightly coupling the nozzle plate to a suction arrangement that includes a pump; and when supplying the ink stored in the ink supply source to each of the ink supply ports via the flow channel arrangement by performing sucking with the pump, sucking of the ink is stopped from a time point when one of the branched flow channels is entirely filled with the ink until air in the flow channel arrangement moves in the branching portion, and the sucking is resumed when the air has moved in the branching portion.

In the ink filling method according to Claim 2 of the present invention, in the invention according to Claim 1, stopping of the sucking and resuming of the sucking is repeated a plurality of times.

In the ink filling method according to Claim 3 of the present invention, in the invention according to Claim 1 or 2, an ink suction rate at the sucking is between 0.16 cc/sec and 0.29 cc/sec.

An inkjet printer according to Claim 4 of the present invention has an ink charging function that employs the ink filling method according to any one of Claims 1 to 3.

Advantages of the Invention

According to the present invention, when charging the ink into the printer head having the plurality of ink supply ports, sucking is performed by using the pump, and the pump is stopped from a time point when one of the branched flow channels is entirely filled with the ink until the air in the flow channel arrangement moves in the branching portion, and the sucking is resumed thereafter. An amount of air in the branched flow channels becomes uniform when the air moves in the branching portion, and flow channel resistances in the branched flow channels becomes substantially the same. Sucking through both the branched flow channels can be performed to the same extent by resuming sucking in this state. Consequently, according to the present invention, the air in the flow channel arrangement can be completely drawn out, and the ink can be charged without leaving behind air in the flow channel arrangement that causes a discharge failure.

BEST MODE(S) FOR CARRYING OUT THE INVENTION

Exemplary embodiments of an ink filling method according to the present invention are explained in detail below while referring to the accompanying drawings.

Figure 1:
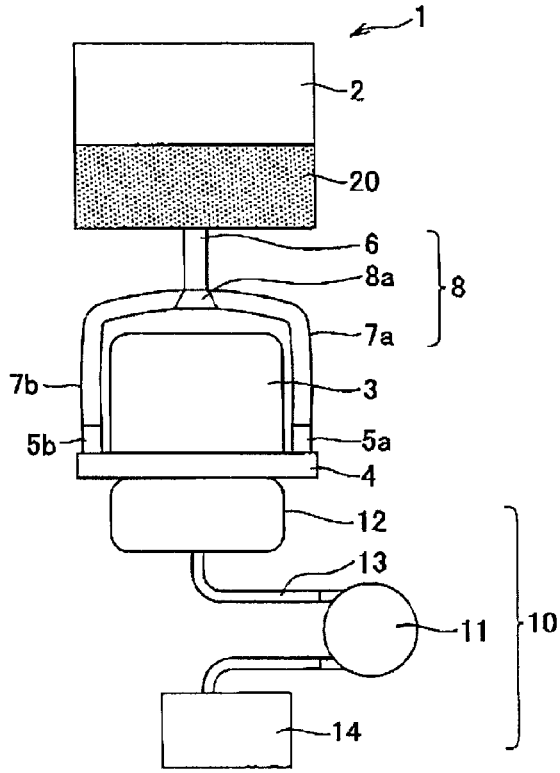
FIG. 1 is a schematic diagram showing an exemplary structure of a printer head.

FIG. 1 is a schematic diagram showing an exemplary structure of a printer head into which an ink is charged by the ink filling method according to the present invention.

A printer head 1 is arranged in an inkjet printer. The printer head 1 performs printing by discharging an ink 20 contained in an ink tank 2 from numerous nozzle pores (not shown) of a nozzle plate 4 provided in a head unit 3.

A plurality of (two in the current example) ink supply ports 5*a* and 5*b* are arranged on either sides of the head unit 3 in the printer head 1. Such a structure is employed to supply the ink to a plurality of locations on the nozzle plate 4 in a divided manner and to uniformly discharge the ink from an entire surface of the nozzle plate 4 that is arranged below the head unit 3. That is, the printer head 1 includes one ink flow channel 6 that communicates with the ink tank 2, and a flow channel arrangement 8 constituting a plurality of branched flow channels 7*a* and 7*b* that branch from the ink flow channel 6 and communicate with corresponding ones of the ink supply ports 5*a* and 5*b* of the head unit 3. The flow channel arrangement 8 is made of, for example, flexible synthetic resin tubes.

The ink is charged into the printer head 1 in the following manner. That is, the surface of the nozzle plate 4 is air-tightly covered with a suction arrangement 10 that includes a pump 11, and the ink 20 stored in the ink tank 2 is supplied to the corresponding ones of the ink supply ports 5*a* and 5*b* via the flow channel arrangement 8 by performing sucking with the pump 11.

The suction arrangement 10 includes a cap 12. The cap 12 is of a size that air-tightly fits with the surface of the nozzle plate 4 of the printer head 1. The cap 12 is provided with a through hole (not shown) that communicates with a waste ink tank 14 via a suction tube 13 that is flexible and made of synthetic resin. The suction pump 11 is arranged in the middle of the suction tube 13.

A suction pressure is generated on the side of the head unit 3 by driving the suction pump 11. The suction pressure causes the ink stored in the ink tank 2 to forcefully flow inside the head unit 3 via the ink supply ports 5*a* and 5*b* and the flow channel arrangement 8.

In general, a consumption of an ink during ordinary printing operation is of the order that produces only a gentle circulation in the entire ink so that a balance is maintained between supply of the ink to the nozzles and refilling of the ink into the head unit 3. In contrast, in the initial charging, or when an ink cartridge is replaced, a purge process is performed to remove air that sometimes enters the flow channel. Vigorous circulation is produced during the purge process in the ink 20 for removing air 21 together with the ink 20. If an imbalance is generated in flow channel resistances inside the branched flow channels 7*a* and 7*b*, the ink 20 tends to flow toward a place where the flow channel resistance is relatively low.

Figure 2:
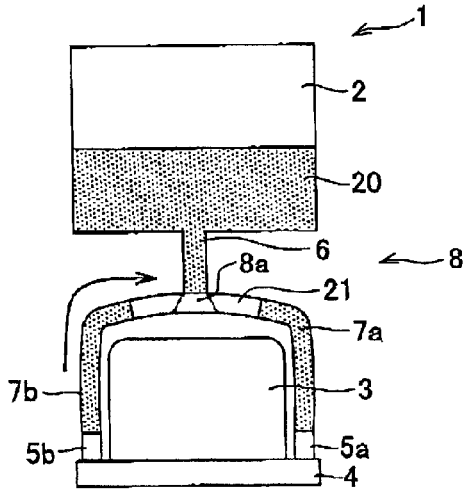
FIG. 2 is a schematic diagram showing how an ink flows inside the printer head in a charging method according to the present invention.
Figure 3:
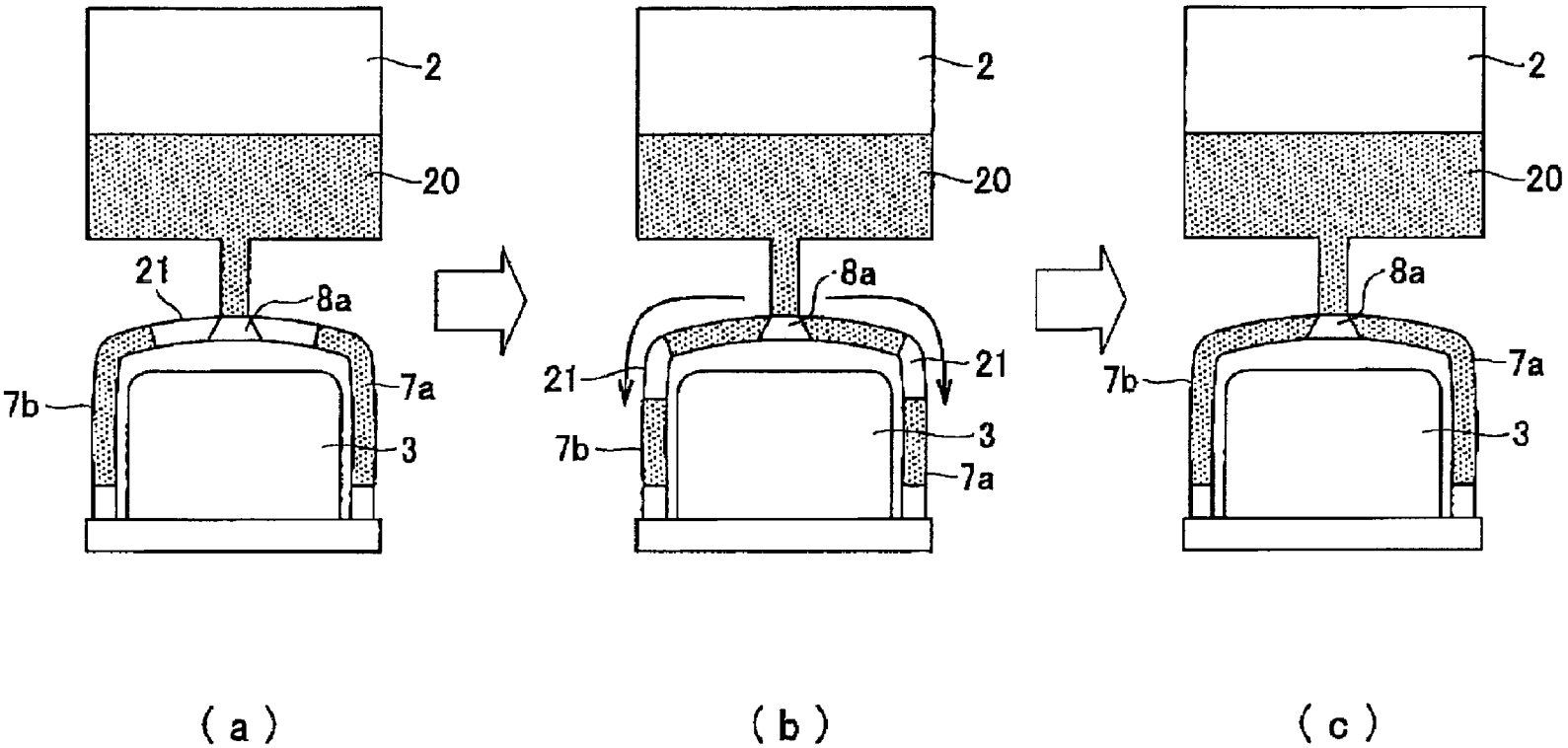
FIG. 3 is a schematic diagram showing how the ink flows inside the printer head in the charging method according to the present invention.
Figure 4:
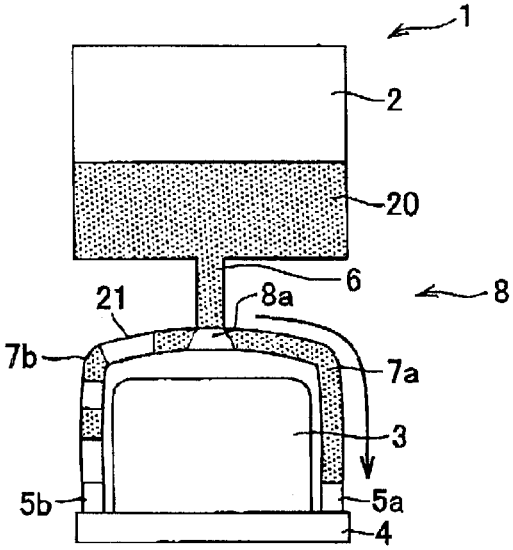
FIG. 4 is a schematic diagram showing how an ink flows inside a printer head in a conventional charging method.
Figure 5:
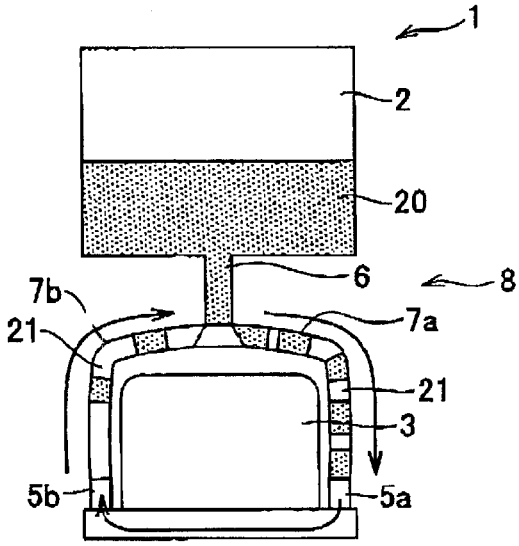
FIG. 5 is a schematic diagram showing how the ink flows inside the printer head in the conventional charging method.

FIGS. 4 and 5, and later-explained FIGS. 2 and 3, are schematic diagrams showing how the ink flows inside the printer head 1 when charging the ink. Meanwhile, the suction arrangement 10 has been omitted from these figures.

In the conventional ink filling method, the ink is simply sucked continuously for a predetermined time with the suction pump 11. In this case, however, as shown in FIG. 4, for example, the ink 20 flows only through the branched flow channel 7*a* that permits easy flow and a less amount of the ink 20 flows through the other branched flow channel 7*b*.

When the ink is charged in a state where less ink has passed, several layers of the ink 20 and the air 21 flow continuously. A branched flow channel that permits easy flow is the branched flow channel 7*a* in which the layers of the ink 20 and the air 21 are relatively few. Fewer the layers are, lower the flow channel resistance is.

At a certain point in time, the layers of the air 21 in the branched flow channel 7*a* vanish before they vanish in the other branched flow channel 7*b*. Consequently, the flow channel resistance in the branched flow channel 7*a* decreases greatly in comparison to that in the branched flow channel 7*b*. In this situation, the ink 20 flows only through the branched flow channel 7*a*.

Thus, in the conventional ink filling method that involves simply sucking the ink continuously for a predetermined time with the suction pump 11, as shown in FIG. 5, for example, the ink 20 is sucked only from the branched flow channel 7*a* that permits easy suction, and the sucked ink and the sucked air 21 flow in the other branched flow channel 7*b*, thereby producing a closed cycle. As a result, a situation occurs where the air 21 can never be drawn out.

In the ink filling method according to the present invention, sucking is stopped from a time point when one of the branched flow channels is entirely filled with the ink 20 until the air 21 in the other branched flow channel moves in a branching portion 8*a*, and sucking is resumed when the air 21 has moved in the branching portion 8*a*.

As shown in FIG. 2, an amount of the air 21 in each of the branched flow channels 7*a* and 7*b* becomes uniform when the air 21 moves in the branching portion 8*a*, and the flow channel resistances in the branched flow channels 7*a* and 7*b* can be made substantially the same. Sucking through both the branched flow channels 7*a* and 7*b* can be performed to the same extent by resuming sucking in this state. Consequently, according to the present invention, the air 21 in the flow channel arrangement 8 can be completely drawn out, and the ink can be charged without leaving behind the air 21 in the flow channel arrangement 8 that causes a discharge failure.

Concretely, as shown in FIG. 2, the sucking is temporarily stopped when one of the branched flow channels 7*a* is entirely filled with the ink 20. Consequently, the air 21 remaining in the other branched flow channel 7*b* from which the ink 20 could not be sucked rises and moves near a top of the head. Subsequently, as shown in FIG. 3(*a*), the air 21 moves even in the branched flow channel 7*a*, and the amount of the air 21 in both the branched flow channels 7*a* and 7*b* becomes almost uniform. It should be noted that the air 21 will not flow in the ink flow channel 6.

The layers of the air 21 stick together over time and form one bigger layer of the air 21. The flow channel resistance in each of the branched flow channels 7*a* and 7*b* becomes substantially the same when the amount of the air 21 in each of the branched flow channels 7*a* and 7*b* is balanced. When this state is attained, as shown in FIG. 3(*b*), the sucking through both the branched flow channels 7*a* and 7*b* can be performed to the same extent, and as shown in FIG. 3(*c*), the air 21 in the branched flow channels 7*a* and 7*b* can be completely drawn out.

In practice, the air 21 may remain behind in the form of separated layers even after lapse of time, and the air 21 in one of the branched flow channels 7*a* and 7*b* may remain behind without being drawn out in one set of the above operation. Therefore, it is preferable that the stopping of the sucking and the resuming of the sucking is repeated plural times.

Meanwhile, in the present invention, it is preferable that an ink suction rate be between 0.16 cc/sec and 0.29 cc/sec. When the ink suction rate is in this range, the air 21 in the branched flow channels 7*a* and 7*b* that can produce the discharge failure can be drawn out effectively, and the ink 20 can be surely changed without the air 21 remaining in the branched flow channels 7*a* and 7*b*. In contrast, if the ink suction rate is higher than 0.29 cc/sec, a closed cycle of the ink as shown in FIG. 5 is generated, thereby creating a situation where the air 21 can never be drawn out. On the other hand, if the ink suction rate is lower than 0.16 cc/sec, a suction power is low, and the air cannot be sucked as desired. That is, because the buoyancy of the air 21 is higher than the suction power, the ink 20 passes through a gap between the wall of the tube and the air 21 inside the branched flow channels 7*a* and 7*b*, and the air 21 remains in the branched flow channels 7*a* and 7*b* without being drawn out.

Meanwhile, in the present invention, the ink suction rate is a rate of flow of the ink 20 in one of the branched flow channels when the ink 20 is sucked uniformly from the two branched flow channels 7*a* and 7*b* simultaneously, and when tubes having an internal diameter of 3 millimeter (mm) and a length of 65 mm are used as the flow channel arrangement 8 and the tubes are completely filled with the ink 20.

As explained above, according to the present invention, it is possible to move the air into the branching portion of the flow channel arrangement by stopping the sucking of the ink for a predetermined time after beginning the sucking of the ink, and thereafter, sucking through both the branched flow channels can be performed to the same extent. Consequently, according to the present invention, the air in the flow channel arrangement can be completely drawn out, and the ink can be charged without leaving behind the air in the flow channel arrangement that causes the discharge failure.

The present invention should not be interpreted as limited to the foregoing description of the embodiments and may be practiced by making various modifications to the foregoing embodiments without departing from the gist of the invention.

For example, an example of charging ink into a printer head having two ink supply ports has been explained above; however, the present invention is not limited to this, and it is possible to apply the present invention to charging ink into a printer head having three or more ink supply ports.

INDUSTRIAL APPLICABILITY

The present invention is applicable to the ink filling method for the printer head having a plurality of the ink supply ports.

The invention claimed is:

1. An ink filling method for a printer head that includes
- a head unit that has a plurality of ink supply ports to which an ink is supplied and that performs printing by discharging an ink from a nozzle plate provided in a lower portion;
- an ink supply source arranged outside the head unit; and
- a flow channel element including one ink flow channel that connects with the ink supply source, and a plurality of branched flow channels that branch out from the ink flow channel and respectively connects with the ink supply ports, the ink filling method comprising:
- air-tightly coupling the nozzle plate to a suction arrangement that includes a pump;
- when supplying the ink stored in the ink supply source to each of the ink supply ports via the flow channel element by performing sucking with the pump, the sucking is stopped when one of the branched flow channels is entirely filled with the ink;
- waiting a predetermined time until air in the flow channel element moves to a branching portion, and
- the sucking is resumed after the air is moved to the branching portion.

2. An inkjet printer having an ink filling function that employs the ink filling method according to claim 1.

3. The ink filling method according to claim 1, wherein an ink suction rate at the sucking is between 0.16 cc/sec and 0.29 cc/sec.

4. An inkjet printer having an ink filling function that employs the ink filling method according to claim 3.

5. The ink filling method according to claim 1, wherein the waiting step and resuming of the sucking step are repeated a plurality of times.

6. An inkjet printer having an ink filling function that employs the ink filling method according to claim 5.

7. The ink filling method according to claim 5, wherein an ink suction rate at the sucking is between 0.16 cc/sec and 0.29 cc/sec.

8. An inkjet printer having an ink filling function that employs the ink filling method according to claim 7.

* * * * *